United States Patent [19]

Geyer et al.

[11] 4,453,367

[45] Jun. 12, 1984

[54] HONEYCOMB CORE MATERIAL AND SANDWICH CONSTRUCTION STRUCTURAL BUILDING MATERIALS INCORPORATING SAME

[75] Inventors: Eugen J. Geyer, Huybergen; Eugen K. Mössner, Bergen op Zoom, both of Netherlands

[73] Assignee: General Electric Company, Pittsfield, Mass.

[21] Appl. No.: 282,145

[22] Filed: Jul. 10, 1981

[51] Int. Cl.[3] ..... E04C 2/36

[52] U.S. Cl. ..... 52/806; 264/177 R; 428/73; 428/116

[58] Field of Search ..... 52/806, 798; 428/116, 428/118, 73, 184, 186; 264/148–150, 177 R, 89, 73; 425/464

[56] References Cited

U.S. PATENT DOCUMENTS

| | | | |
|---|---|---|---|
| 3,679,384 | 7/1972 | Colson et al. | 428/116 |
| 3,825,641 | 7/1974 | Barnett | 264/177 R |
| 3,913,702 | 10/1975 | Wirt et al. | 428/118 |
| 3,983,283 | 9/1976 | Bagley | 428/116 |
| 4,242,849 | 1/1981 | Benkelman et al. | 52/741 |

FOREIGN PATENT DOCUMENTS

| | | | |
|---|---|---|---|
| 457096 | 5/1949 | Canada | 428/73 |

*Primary Examiner*—James L. Ridgill, Jr.

*Attorney, Agent, or Firm*—Hedman, Gibson, Costigan & Hoare

[57] ABSTRACT

A structural panel is of sandwich construction including upper and lower face sheets bonded to a central core. The latter is formed of a plurality of extrusion products disposed in abutting relationship, with each product being a unitary piece of longitudinally extending extrusion material having a matrix of interior walls which define the interior portion of each piece into a regular array of hexagonally-shaped apertures. The longitudinal axes of said apertures extend generally perpendicular to the planes of the upper and lower cover sheets. The resulting structural panel may be readily formed into a three-dimensional shape of enhanced strength.

6 Claims, 4 Drawing Figures

HONEYCOMB CORE MATERIAL AND SANDWICH CONSTRUCTION STRUCTURAL BUILDING MATERIALS INCORPORATING SAME

BACKGROUND OF THE INVENTION

The present invention relates to honeycomb core materials used in sandwich construction building materials. More particularly, it relates to a new and improved extrusion product formed of a unitary piece of longitudinally extending extruded material having a matrix of interior walls which divide the interior portion of the extruded product into a regular array of hexagonally-shaped openings or apertures. The subject invention also relates to new and improved structure building panel of sandwich construction wherein the core section is formed by an array of the new and improved extrusion products disposed in abutting relationship.

Exhibiting high stiffness-to-weight ratios, honeycomb sandwich panels have long been preferred as structural building materials. Such panels are light in weight and very strong. An added feature of honeycomb sandwich structures is that they act as good thermal insulating materials due to the relatively large amounts of dead air space located within the honeycomb core itself. Given the above characteristics it is easily understood that honeycomb sandwich materials figure predominantly in the manufacture of aircraft structures such as portions of the wings, fuselage, and tail sections, as well as in the interior structures of various transportation vehicles, such as for example, floors, bulkheads, and ceilings of trains and buses. When used as packaging or structural elements for appliances and other components, the lightweight feature of honeycomb structures lends increased portability to such products.

Honeycomb cores for sandwich panels have been made from various materials in many different ways. One conventional honeycomb core material is comprised of red A, resonated paper product. Several sheets of the paper or other materials arearranged on top of one another with the sheets being adhesively bonded together along alternating glue lines. The layered sheets thus form a block which may be sliced into a panel of desired thickness. The opposed ends of the resulting core panel are then pulled in opposite directions to expand the several layers to form a honeycomb lattice. The expanded panel is then repeatedly dipped in resins and cured to retain the honeycomb structure.

Another honeycomb core mateial is prepared by first pre-forming a sheet of material by pressing, molding or extruding the sheet so that its surface is defined by alternating strips of semi-hexagonal depressions. The sheets are then layered one atop the other in a staggered fashion so that they form a hexagonal honeycomb with adjacent sheets being welded or adhesively bonded together along each of the faces where they meet.

A further conventional honeycomb core material is comprised of a plurality of tubes adhesively bonded together to form a solid block. These materials are prepared by first extruding elongated tubes, drawing the tubes through an adhesive, aligning them in a frame, and then allowing them to set. One limitation of honeycomb structures provided by this method is that they are very expensive due to the number and difficulty of the process steps required for their manufacture.

Improvements in the field of extrusion technology have led to the development of so-called structured sheets. Structured sheets are single piece extrusion products in the form of two parallel sheets having a plurality of perpendicular ribs extending between them. These structured sheets have an improved stiffness because they are in the form of a single sheet. Such products when rendered out of transparent materials have been used in structural elements for skylights, as for example described in U.S. Pat. No. 4,242,849, for greenhouses and for the surfaces of solar collecting panels.

A major problem with all of the above mentioned honeycomb core materials is that they all include some form of adhesive bonds or joints within the honeycomb structure. Typically, the material that the honeycomb is made from has a greater flexibility than the adhesive joints within the honeycomb. Sandwich construction building panels in corporating the above mentioned honeycomb structures as a core material cannot readily tolerate bending since internal stresses could cause the adhesive joints to pop or become unattached, or the honeycomb materials may buckle or tear. The latter destroys the structural integrity of the honeycomb core thereby greatly reducing the rigidity and strength of sandwich construction building material incorporating the above mentioned honeycomb core products.This effectively limits the applications for sandwich construction building materials made with such honeycomb cores to building panels which are planar in configuration or to panels having only a slight curvature.

Accordingly, in order to overcome the shortcomings of the prior art materials, it is an object of the subject invention to provide a new and improved extrusion product in the form of a unitary piece of extruded material having a cellular honeycomb configuration for use in sandwich structure building materials.

It is another object of the subject invention to provide a new and improved honeycomb core material in the form of a unitary piece of extruded material which does not include adhesive or bonded joints.

It is a further object of the subject invention to provide a new and improved sandwich construction building material which may be formed in a three dimensional shape of enhanced structural stiffness and strength.

It is still another object of the subject invention to provide new and improved honeycomb core materials and new and improved sandwich construction building materials which may be efficiently and economically produced.

SUMMARY OF THE INVENTION

In accordance with these and many other objects, the subject invention provides a new and improved extrusion product for use in sandwich construction building materials. More particularly, an elongated unitary piece of extruded material is provided which has an interior portion including a matrix of interior walls extending along its length. The matrix of interior walls divide the interior portion so as to define a regular array of hexagonal openings or apertures extending along the length thereof so as to define a cellular honeycomb configuration.

The subject invention also includes new and improved structural building panels made in a sandwich construction, and including upper and lower face panels adhesively bonded to an interior honeycomb core material. The interior honeycomb core material is formed of an array of the new and improved extrusion product disposed in abutting relationship. The new and improved structural building panel provided by the subject invention exhibits a high stiffness-to-weight ratio. The new and improved structural building panel of the subject invention may be thermoformed into three dimensional shapes without compromising its stiffness-to-weight ratio, thereby providing a sandwich construction, structural building panel for applications heretofore unavailable in the building art.

Further objects and advantages of the subject invention will become apparent from the following detailed description taken in conjunction with the drawings in which:

DETAILED DESCRIPTION OF THE PREFERRED EMBODIMENT

Figure 1:
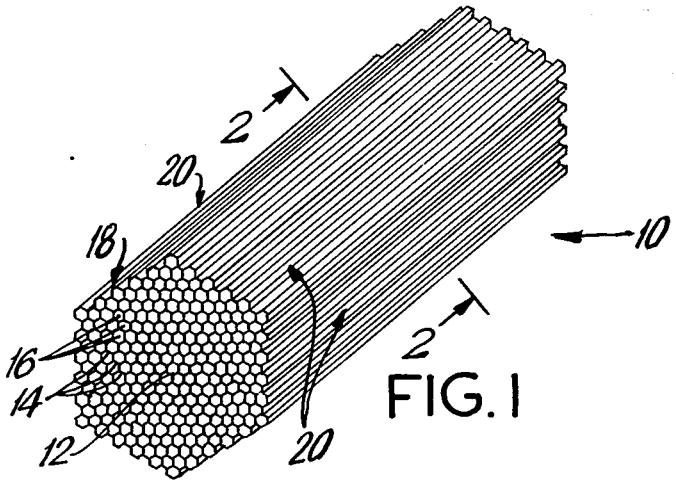
FIG. 1 is a perspective view of the new and improved extrusion product of the subject invention.

Referring to FIG. 1, the new and improved extrusion product of the subject invention is generally designated by the numeral 10. The new and improved extrusion product 10 is an elongated, unitary piece, preferably formed of extruded plastic material. However, extrusion product 10 may also be made of metals or other material, subject to the degree of processability of such materials. The interior portion 12 of extrusion product 10 includes a matrix of longitudinally extending interior walls 14 which divide the interior portion 12 in such a manner as to define a regular array of hexagonal openings or apertures 16 which extend longitudinally along the length of extrusion product 10. The perimeter 18 of extrusion product 10 is of a general hexagonal configuration. Each side 20 of the perimeter 18 is defined by alternating semi-hexagonal extensions 22 and semi-hexagonal indentations 24. In addition, the corners along perimeter 18 are defined by four sided hexagonal extensions 26. The perimeter 18 of extrusion product 10 therefore has an irregular appearance as illustrated in FIG. 1.

Figure 3:
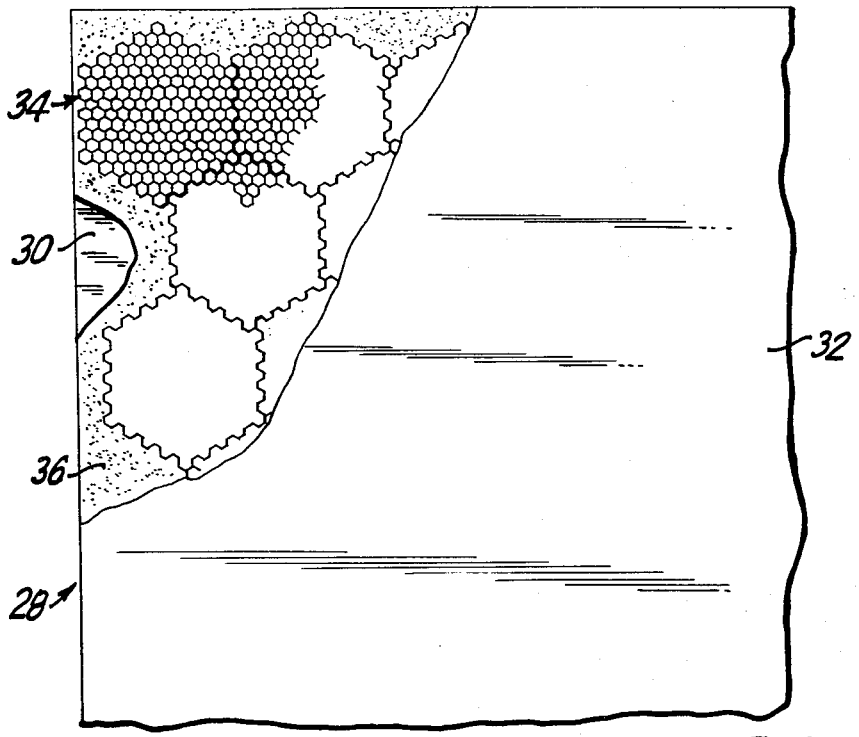
FIG. 3 is a plan view of the new and improved structural building panel of the subject invention, with a portion of the upper face panel being partially cut away.
Figure 4:
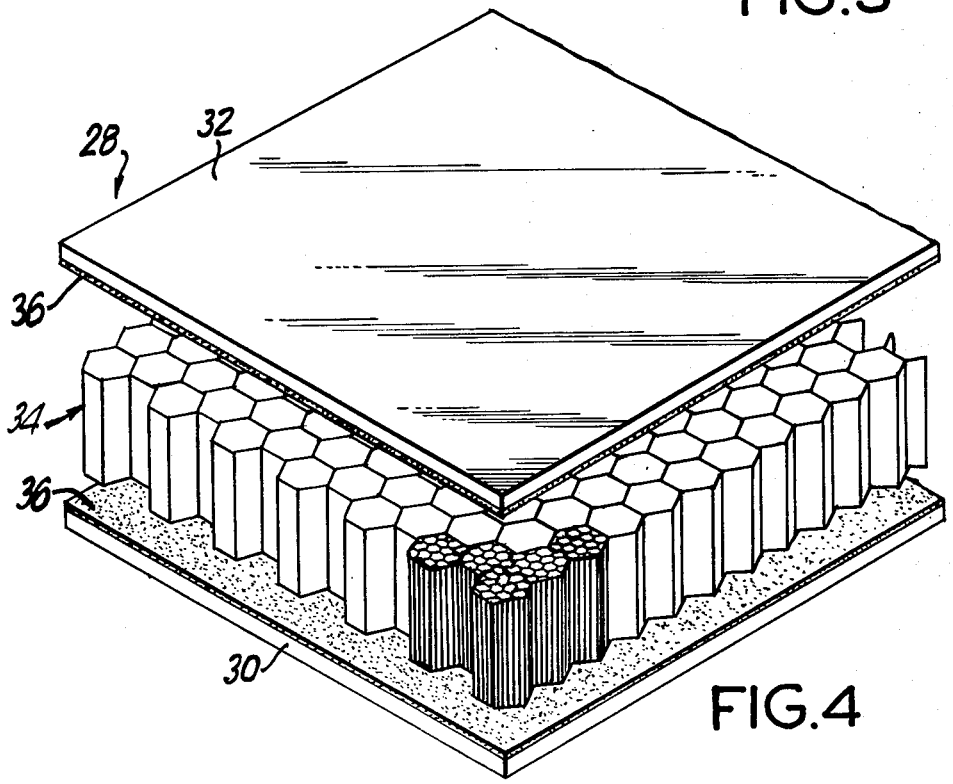
FIG. 4 is an exploded perspective view of the new and improved structural building panel of the subject invention.

The new and improved elongated extrusion product 10 is intended for use in a sandwich structure building material 28 as shown in FIGS. 3 and 4. Sandwich panel 28 has a lower face panel 30, an upper face panel 32, and an intermediate core section 34. Lower face panel 30 and upper face panel 32 may also be made of plastic, and are adhesively bonded to the intermediate core section 34 by means of adhesive 36. Intermediate core section 34 is comprised of an array of the elongated extrusion products 10, each of which may be formed from a longitudinally extending, unitary piece of extruded material of the type depicted in FIG. 1. As shown in FIG. 3 the extrusion products 10 comprising core section 34 are arrayed in abutting relationship, with the semi-hexagonal extensions 22 extending from sides 20 of any one of said extrusion products 10 being interengaged with the semi-hexagonal indentations 24 in the sides 20 of the adjacent extrusion products 10. Because the extrusion products 10 are adhesively bonded to the lower face panel 30 at one end and the upper face panel 32 at the other end, by means of adhesive 36, the need for intermediate adhesive joints between the elongated extrusion products 10 within the array of core section 34 is eliminated.

The resulting sandwich panel 28 may be made flexible in every direction by control heat so that sandwich panel 28 may be readily thermoformed into a three dimensional shape. This lack of adhesive joints within the core material sandwich panel 28 also allows the intermediate core material to absorb to a large extent any differences in thermal expansion between the upper and lower face panels 30 and 32, respectively, and the intermediate core section 34, i.e., - each extrusion product 10 within the array of intermediate core section 34 has a degree of flexibility in the vertical direction that is in a direction perpendicular to the planes defined by lower face panel 30 and upper face panel 32.

The new and improved extrusion products of the subject invention may be prepared in accordance with multiwall hollow chamber extrusion technology. Basically, the latter entails passing an extrudable material through a series of machines arranged in assembly line including, and in the following order, an extruding machine, a calibration unit, an extended assembly line equipped with cool air jets, and a cutter mechanism. The first step in the procedure is to introduce the extrudable material into the extruding machine. Generally, the extrudable material is a thermoplastic material but any extrudable materials known to the art such as metals and other man-made products may be used. An extruding machine generally includes a hopper section, a feed chamber equipped with a screw mechanism, a heating chamber, a nozzle, and a die. The extrudable material is introduced to the hopper section of the extruding machine which is inclined so as to feed the extrudable material by gravity into the feed chamber. The screw mechanism rotates within the feed chamber and forces the extrudable material towards the nozzle and the die. A heating chamber extends from a point intermediate the length of the heat chamber through to the nozzle and serves to melt the extrudable material into liquid or semi-liquid form, and is of a length such that the extrudable material is free flowing by the time it reaches the die. The nozzle contains the die and directs the extrudable material thereto. The die is the opening through which the liquid material will pass. The shape of the die will determine the shape of the extrudate following therefrom. More particularly, the die acts as a negative template. such that solid structures within the die produce hollow spaces within the extrudate. The extrudate then passes to the calibration unit. The interior of the calibration unit through which the extrudate passes has a configuration corresponding to the exterior perimeter of the extrudate and is designed to closely receive the extrudat therethrough. The interior walls of the calibration unit have apertures therein which communicate with ducts which extend to an ordinary vacuum pump. When the vacuum pump is operative a suction is created near the internal walls of the calibration unit which draws the external perimeter of the extrudate to the walls thereby preventing the collapse of the structure of the extrudate which is still in a heated semi-liquid state as it enters and travels through the beginning sections of the calibration unit. The calibration unit is further provided with a cooling system extending along its length which operates to cool the extrudate to a solid form before it leaves the calibration unit. The extrudate then passes directly onto a conveyor belt which is equipped with cool air jets which function to further solidify the extrudate into the configuration imparted to it by the die. The extrudate then travels along the conveyor belt until it reaches the cutter device which can be set to cut the continuous extrudate into desired lengths.

The new and improved extrusion products of the subject invention include a matrix of interior walls. A problem arises in the extrusion of such structures in that as the extrudate passes to and through the calibration unit, the exterior portions of the extrudate are cooled while the internal wall structure thereof remain fairly hot by comparison. This could lead to the problem that the matrix of interior walls imparted by the die might be lost due to melt-down. The occurrence of such melt-downs in the interior of the extrudate is effectively avoided by pre-cooling the interior section of the extrudate. As mentioned above, solid forms within the die create spaces in the extrudable material flowing therethrough. The pre-cooling of the interior of the extrudate is accomplished by providing tiny air jets disposed at the downstream end of the solid forms within the die. These tiny airjets also serve another function when the extrusion process is just begun. As the leading edge of the extrude passes out of the die and into the calibration unit, the exterior walls of the extrudate may or may not become engaged with the vacuum suction located along the interior walls of the calibration unit. The leading edge of the extrudate is allowed to pass through the calibration unit as the leading edge is closd off. The air flow provided by the tiny air jets within the solid form of the die then act to inflate or balloon the extrudate to facilitate the engagement of the external walls of the extrudate with the vacuum suction of the calibration unit.

Figure 2:
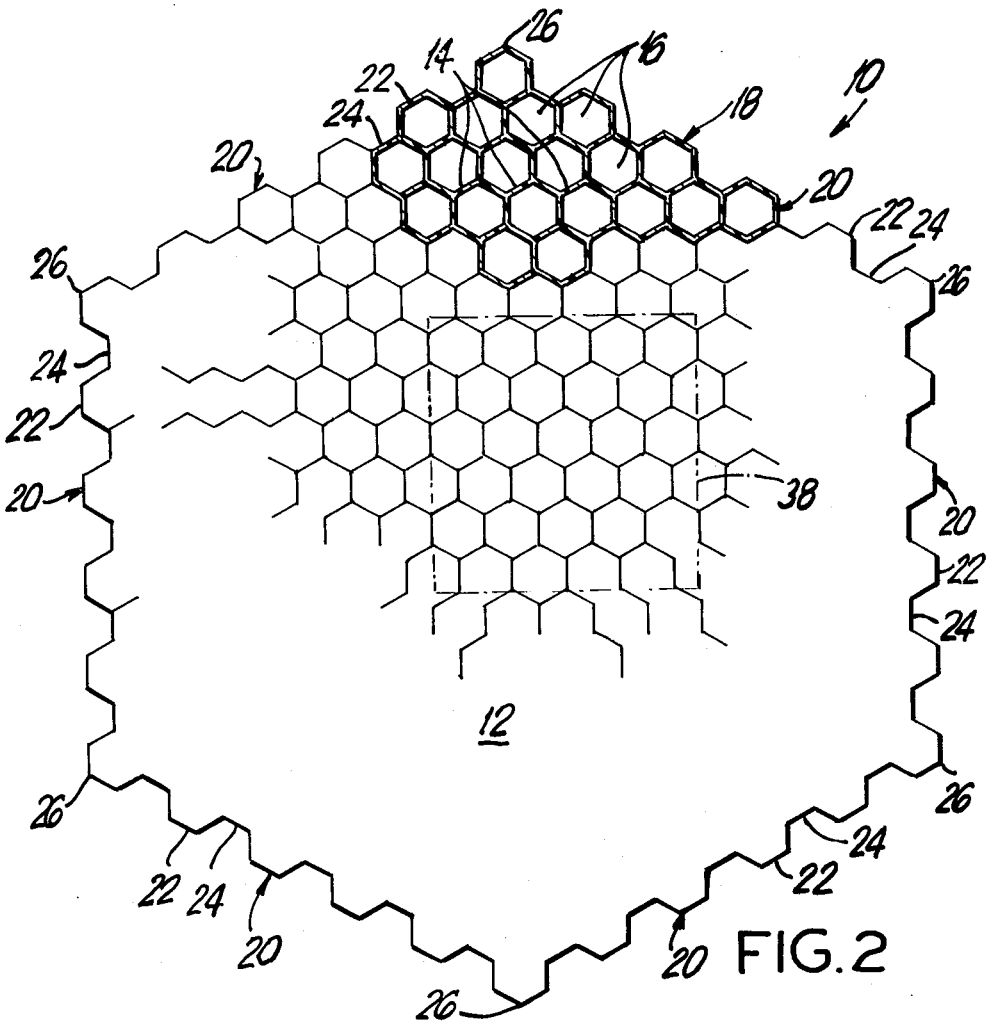
FIG. 2 is a cross-sectional view of the new and improved extrusion product of the subject invention, taken along line 2—2 of FIG. 1.

The new and improved extrusion product of the subject invention may have perimeters shaped in configurations other than hexagonal. For example, an alternate extrusion product may have a rectangular perimeter 38,as shown in phantom in FIG. 2. However, the preferred geometry of the extrusion product 10 of the subject invention includes a hexagonal perimeter such that the interengaged walls of the matrix of products insures that any external forces exerted on the perimeter of the panel will be transmitted throughout the sandwich structure and along the matrix of interior walls.

While the subject invention has been described with reference to a preferred embodiment, it is apparent that various modifications and changes can be made therein by one skilled in the art without departing from the scope and spirit of the subject invention as defined by the appended claims.

We claim:

1. A structural building panel adapted to be thermoformed into three dimensional shapes without compromising its stiffness-to-weight ratio, said building panel comprising a sandwich structure including an upper face panel, a lower face panel, and an intermediate core, said upper and lower face panels being adhesively bonded to said intermediate core, the latter comprising an array of elongated extrusion products, each product being a longitudinally extending unitary piece formed of extruded plastic, each of said elongated extrusion products having an interior portion including a matrix of longitudinally extending interior walls, said matrix of interior walls dividing said interior portion in such manner as to define a regular array of hexagonal apertures extending longitudinally therethrough, said array of extrusion products being in abutting relationship, and being free of intermediate adhesive joints between the extrusion products within the array.

2. A structural building panel as recited in claim 1 wherein each said unitary piece of extruded plastic material is generally hexagonal in cross-section.

3. A structural building panel as recited in claim 1 wherein each of said elongated extrusion products further includes an external perimeter of generally hexagonal configuration, and wherein each side of said perimeter is defined by alternating semi-hexagonal extensions and semi-hexagonal indentations, with each of the corners of said perimeter being a four-sided hexagonal extension, said array of extrusion products being in abutting relationship such that the semi-hexagonal extensions on the sides of any one of said extrusion products are interengaged with the semi-hexagonal indentations of the adjacent extrusion products.

4. A structural building panel as recited in claim 3 wherein said upper and lower face panels and said intermediate core are formed of plastic material.

5. A structural building panel adapted to be thermoformed into three dimensional shapes without compromising its stiffness-to-weight ratio, said building panel comprising a sandwich structure including an upper face panel, a lower face panel and an intermediate core, said upper and lower face panels being adhesively bonded to said intermediate core, the latter comprising an array of elongated extrusion products, said array of extrusion products being in abutting relationship and being free of intermediate adhesive joints between the extrusion product within the array, each said extrusion products being a longitudinally extending, unitary piece formed of extruded plastic and having an interior portion including a matrix of longitudinally extending interior walls, said matrix of interior walls dividing said interior portion in such manner as to define a regular array of hexagonal apertures extending longitudinally therethrough, said extrusion product being formed by a multi-wall hollow chamber extrusion process, said process comprising:

(a) passing said plastic through an extruding machine to form an extrudate, said extruding machine being equipped with a die including solid forms capable of providing hollow spaces within the extrudate in such manner as to provide the interior portion with the matrix of longitudinally extending interior walls and regular array of hexagonal apertures extending longitudinally therethrough;

(b) passing the extrudate so formed through a calibration unit having an interior corresponding to the exterior perimeter of the extrudate, the interior walls of said calibration unit being equipped with appertures which communicate with ducts extending to a vacuum pump whereby a suction may be created near the internal walls of the calibration unit which draws the external perimeter of the extrudate to the interior walls of the calibration unit thereby preventing the collapse of the structure of the extrudate, said callibration unit further including a cooling system extending along its length capable of cooling the extrudate to a solid form before it leaves the calibration unit; thereafter, (c) passing the extrudate onto a conveyor belt equipped with cool air jets to further solidify the extrudate into the configuration imparted to it by the die; and finally, (d) passing the cooled extrudate through a cutter mechanism, capable of cutting the continuous extrudate into desired lengths.

6. A structural building panel as recited in claim 5 wherein said extrusion products are formed by a multi-wall hollow chamber extrusion process as defined in claim 5, and further wherein in said process, the interior of the extrudate is precooled by means of tiny air jets disposed at the downstream end of the solid forms within the die.

* * * * *